United States Patent [19]

Edwards

[11] Patent Number: 4,808,875

[45] Date of Patent: Feb. 28, 1989

[54] LOCKER SHELF AND DRAWER ASSEMBLY

[76] Inventor: John C. Edwards, 9432 E. Placita Cascada, Tucson, Ariz. 85715

[21] Appl. No.: 152,542

[22] Filed: Feb. 5, 1988

[51] Int. Cl.[4] ..... A47B 67/02

[52] U.S. Cl. ..... 312/245; 312/317 R

[58] Field of Search ..... 312/108, 245, 256, 317 R, 312/317 A, 351; 108/33, 48, 156

[56] References Cited

U.S. PATENT DOCUMENTS

| | | | |
|---|---|---|---|
| 2,690,266 | 9/1954 | Johnson . | |
| 3,612,633 | 10/1971 | Bloom . | |
| 3,851,936 | 12/1974 | Muller | 312/245 X |
| 4,099,814 | 7/1978 | Hasselberger . | |
| 4,283,099 | 8/1981 | Burton . | |
| 4,500,146 | 2/1983 | Peterson | 108/107 |

*Primary Examiner*—Joseph Falk

*Attorney, Agent, or Firm*—J. Michael McClanahan

[57] ABSTRACT

A novel locker shelf and drawer assembly for placement interiorly to a locker or other semi-enclosed container providing a shelf above the floor of the locker together with a slidable drawer for holding of books and storage of pencils and the like. The locker shelf and drawer is constructed of two oppositely situated vertical upright members with attached shelf portions. The shelf portions are each characterized by having diagonal converging sides. Further, these diagonal converging sides are also characterized by acute angled beveled edges formed on the sides. Adapted to be received between the converging sides of the left and right shelf portions is a center wedge portion having the same angled converging diagonal sides, with the edges of these sides additionally configured to have the same angled acute beveled edges. Attached to the central wedge is a drawer assembly such that when the central wedge is inserted between the left and right shelf portions, the beveled edges on both the shelf portions and on the wedge portion engage each other and co-acting of the top of the drawer assembly, the center wedge portion is frictionally secured in place. The left and right shelf portions are then forced against the insides of the locker. The invention is so configured as to be securely held against the insides of the locker when assembled, yet being easily removed as desired.

17 Claims, 2 Drawing Sheets

FIG. 1
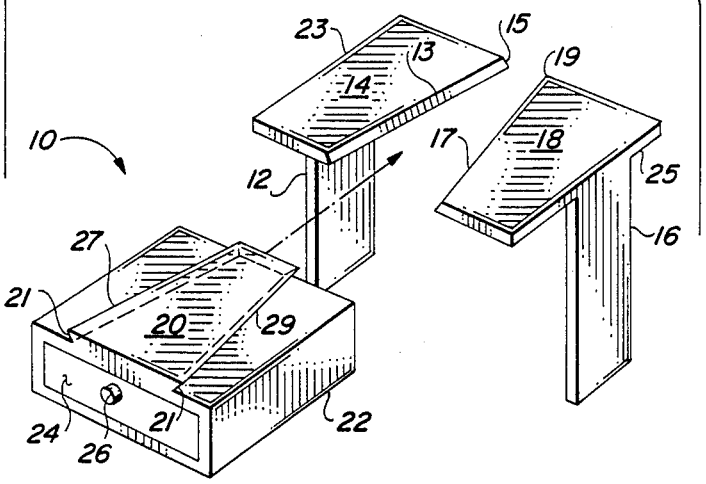
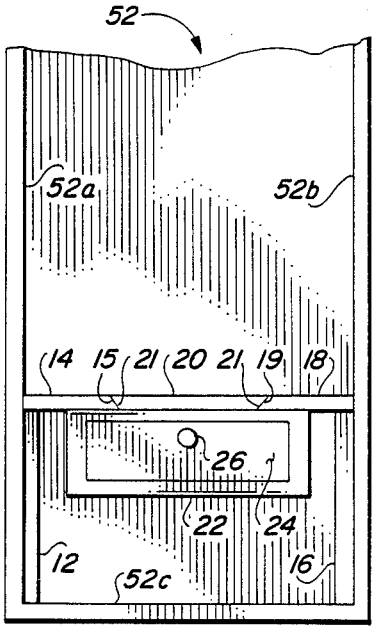
FIG. 4
FIG. 2
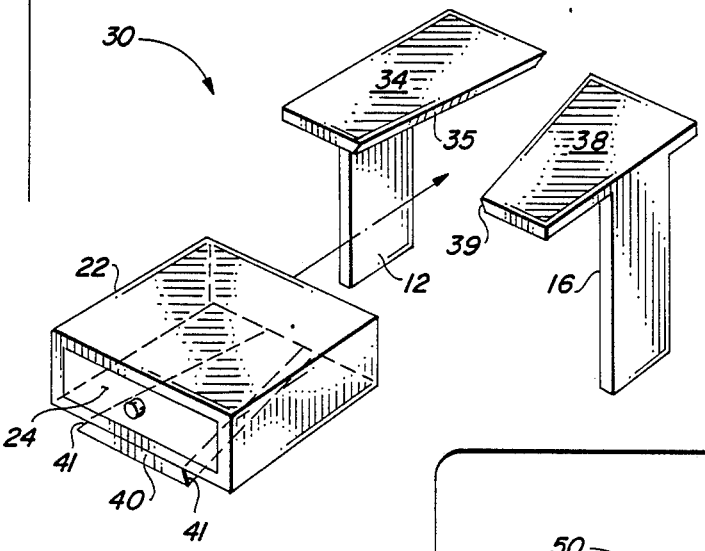
FIG. 3
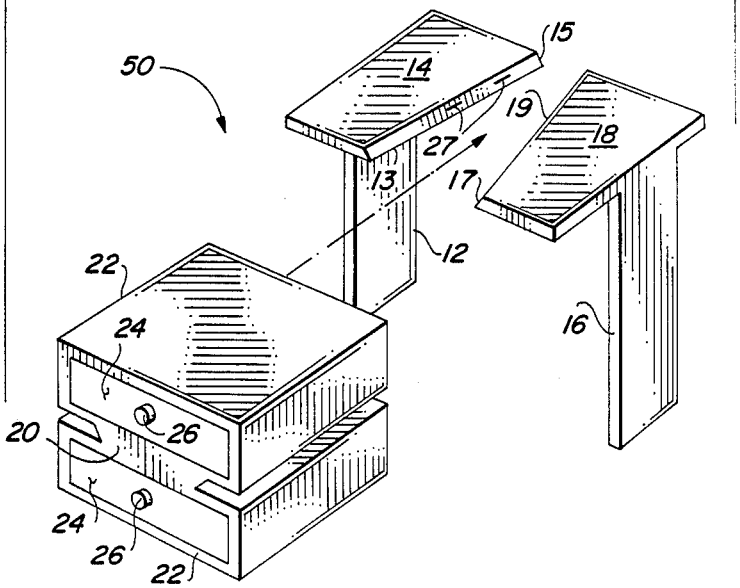
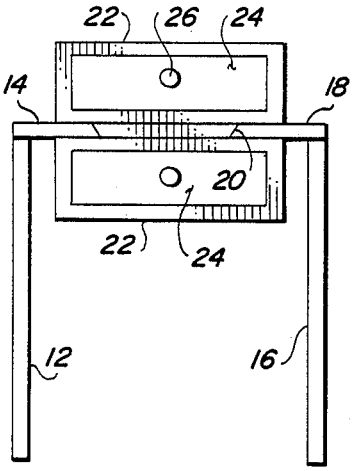
FIG. 5

LOCKER SHELF AND DRAWER ASSEMBLY

BACKGROUND OF THE INVENTION

1. Field of the Invention

The field of the invention is devices adapted to be placed within lockers or other semi-enclosed containers which provide a shelf above the bottom of the locker and additionally have an attached drawer.

2. Description of the Related Art

It is common for schools, especially middle schools and high schools, to provide lockers for students by which means the student may store his books, pencils, lunch, and other paraphernalia during times that the materials are not currently being used. Lockers generally comprise a closable container with a pivotable door, usually lockable, having a base approximately 12 to 14 inches square and a height of 2 to 5 feet. However, no other amenities are usually placed in the locker except, perhaps, hangers may be placed near the top of the locker to suspend articles of clothing belonging to the locker owner or occupant. Nevertheless, the bottom of the locker becomes very quickly jumbled with books and pencils, the student's lunch, and other materials with no seeming order to the stacking or placement. Consequently, whenever there is a need to find a certain book or other object, the student must plow through the unorganized materials to locate the items sought.

It would be obviously useful to the student if a shelf were located spatially above the bottom of the locker which will provide a upper shelf to receive books, lunch, or the like such that with the combination of an upper shelf and lower base, the materials may be separated into at least two groups. Further, it would be additionally useful if a drawer were incorporated with the shelf so that the loose items, such as pencils, erasers, and other small articles, may be readily accessible in one place. This drawer can be made slidable such that it may be pulled out as needed to gain access to its interior, and when not being used, pushed back in to be out of the way of removing or placing objects into the locker.

Now, there have been shelves designed to be emplaced into cabinets, automobile glove compartments, and other containers, including lockers such as those utilized in the school systems. For example, Johnson, in U.S. Pat. No. 2,690,266, places auxiliary shelving into a cabinet; Bloom in U.S. Pat. No. 3,612,633, discloses a shelf support kit adapted to be placed within a semi-enclosed area; and Hasselberger, in U.S. Pat. No. 4,099,814, discloses a shelf arrangement adapted to be placed interiorly to an automobile glove compartment. In addition, Burton, in U.S. Pat. No. 4,283,099, shows an assembly of shelves, having at least one drawer, adapted to be placed interiorly to a locker type cabinet, such as might be utilized in a school. All of the devices disclosed by the above patents are conventional type shelves and drawers generally assembled within the semi-enclosed area requiring a moderate to substantial amount of construction, and which are loose within the locker. In addition, the disclosed devices are relatively time consuming in disassembly and removal.

It is apparent that it would be useful to provide a shelf and a drawer assembly for a locker or other semi-enclosed area which may be assembled within the locker in a very short order of time, not requiring mechanical aptitude on the part of the assembler, and where the assembly is patently obvious. Also, the disassembly of the locker shelf and drawer should be just as easy and obvious as was the assembly. It is also apparent that there would be obvious benefit if the shelf and drawer assembly located in the locker is not subject to side-to-side movement, but in fact engages the insides of the locker or other semi-enclosed containers to be securely held in place. Other benefits that follow securing side-to-side include the fact that by engaging the sides of the locker, no openings are permitted for small items to fall down between the sides of the shelf and the insides of the locker and thus become lost.

Accordingly, there is advantage of providing such a locker shelf and drawer assembly which is easy and fast in assembly and disassembly, does not require mechanical aptitude to assemble and disassemble, and which engages the sides of the locker to secure the shelf in place and to secure the shelf against movement, and also provide security against small items falling down between the sides of the shelf and the insides of the locker.

SUMMARY OF THE INVENTION

This invention relates to a novel locker shelf and drawer assembly placed interiorly to a semi-enclosed container, such as a school locker, in order to provide an additional shelf to receive books and other materials, the shelf being situated spaced above the bottom of the locker, and also provide a slidable drawer in which may be stored loose articles such as pencils, pens, erasers, and the like.

The locker shelf and drawer assembly is characterized by oppositely situated vertical upright side pieces or members which spatially support a composite shelf above the floor of the locker, each vertical member having attached at their respective top end, a left or right portion of the resultant shelf, each left or right portion of the shelf being characterized as having one side cut at a diagonal angle with respect to the opposite side attached to the vertical member and thus also diagonal to the sides of the lockers and to the flat plane formed by the upright members. The diagonal sides of opposite left and right shelf portions converge toward the rear of the locker. In addition, an acute beveled angle is formed on the edge of each of the converging sides as opposed to 90-degree cuts on the edges of the side of the left and right shelf portions at their attachment to their respective vertical members.

A trapezoidal shaped center wedge portion having similarly angled diagonal opposite sides which also converge toward the rear of the locker is adapted to engage the converging diagonal sides of the left and right shelf portions, the wedge also having attached to it a drawer assembly with contained drawer. Edges of the opposite diagonal sides of the center wedge also are cut at acute angles similarly angled to the acute angles of the edges of the diagonal sides of the left and right shelf portions.

The two upright vertical members are placed into the locker floor on opposite sides and the center wedge placed between the diagonal sides of the shelf portions attached to these vertical members and the center wedge inserted in a forcible manner, so as to force outward the shelf portions until their lateral movement is stopped by engaging the opposite sides of the locker. The diagonal sides of the shelf portions having the acute angled edges engage in a frictional locking manner the similarly angled diagonal sides acute angled beveled edges of the center shelf portion. The angled edges of the center wedge co-act with the top surface of the attached drawer assembly to lock the left and right shelf portions in place and hold them there by friction, while at the same time, forcing the two shelf portions against the opposite sides of the locker and thus place the shelf into a secured configuration. The contained slidable drawer in the drawer assembly then may be pulled out and slid back in as desired. The combination of the two opposite shelf portions together with the center wedge shaped shelf portion, each of which have a flat top surface, form a composite flat shelf which runs from side to side across the locker.

To disassemble and to remove the device from the locker, all one need do is pull the wedge from the central area straight outwards and once the friction holding the wedge in place is overcome, the center wedge and the attached drawer assembly with contained drawer is removed.

If desired, rubber or adhesive strips may be placed along the acute angled edges of either or both sides of each opposite shelf portions and/or the center wedge portion to increase the friction between the members. If the angle at which the diagonal sides converge is not great, but is close to being parallel, substantial friction may be built up between the members to resist unintentional wedge pullout It is an object of the subject invention to provide a novel shelf and drawer assembly for placement into the interiorly of a semi-enclosed volume such as a locker.

It is another object of the subject invention to provide a locker shelf and drawer assembly which is easily assembled within the locker.

It is still another object of the subject invention to provide a locker shelf and drawer assembly which may be easily disassembled from the locker.

It is still another object of the subject invention to provide a locker shelf and drawer assembly in which the device is securely held against the sides of the locker.

Other objects of the invention will in part be obvious and will in part appear hereinafter. The invention accordingly comprises the apparatus and method comprising the construction, combination of elements, and arrangement of parts which are exemplified in the following detailed disclosure, and the scope of the Application which will be indicated.

BRIEF DESCRIPTION OF THE DRAWINGS

For further understanding of the nature and objects of the present invention, reference should be had to the following detailed description taken in connection with the accompanying drawings wherein:

FIG. 1 is a perspective view of the preferred embodiment of the subject invention;

FIG. 2 is a perspective view of a first alternate embodiment of the subject invention;

FIG. 3 is a perspective view of a second alternate embodiment of the subject invention;

FIG. 4 is a front view of the preferred embodiment of the subject invention emplaced in a locker;

FIG. 5 is a front view of the second alternate embodiment of the subject invention;

In various views, like index numbers refer to like elements.

DETAILED DESCRIPTION OF THE PREFERRED EMBODIMENT

Figure 6:
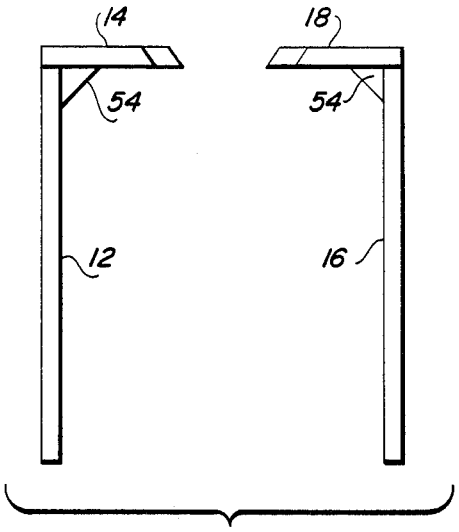
FIG. 6 is a front view of an alternate embodiment of a portion of the subject invention.

Referring now to FIG. 1, a perspective view of the inventive novel locker shelf and assembly drawer 10 is shown. The locker shelf and drawer assembly comprises three basic elements, firstly, a left vertical upright side piece or member 12 with attached left shelf portion 14, a right vertical upright side piece or member 16 with attached right shelf portion 18, and a center shelf portion 20 and drawer assembly 22. The left shelf portion 14, right shelf portion 18, and center shelf portion 20 form a composite shelf. The left and right shelf portions each have a top flat surface and two pairs of opposite sides, the first pair being parallel (front and back), and the second pair having a first side at a diagonal angle to the second side. Under most usual locker situations, the second side of the second pair of sides of the left and right shelf portions is at right angles to the parallel sides. Accordingly, the first side of the second pair of opposite sides is also at a diagonal angle (non-perpendicular) to the parallel first pair of sides.

As can be readily seen in FIG. 1, the left vertical upright member 12 is attached at right angles to the left shelf portion 14 at its side 23, and similarly the right vertical upright member 16 is attached at right angles to the right shelf portion 18 at its side 25. Sides 13 and 17 of left and right shelf portion 14 and 18 respectively are cut at a diagonal or slanted angle with respect to their outermost sides 23 and 25 respectively. Further, sides 13 and 17 converge toward the direction of the rear of the locker shelf and drawer assembly 10. The outermost sides 23 and 25 of the attached left and right shelf portions 14 and 18 respectively are designed to be forcibly urged against the inside vertical surfaces of the locker or other semi-enclosed structure that the subject device is intended to reside within.

The left and right shelf portions, as well as the left and right vertical members 12 and 16 respectively, are forced against the insides of the locker by means of central wedge shelf portion 20 which, having diagonal sides 27 and 29 converging towards the rear, engage sides 13 and 17 of shelf portions 14 and 18 to force the left and right shelf portions apart. It is obvious that the angle of the diagonal sides 27 and 29 must be equal to the diagonal angle of the diagonal sides of the respective left and right shelf portions in order that a smooth joint is accomplished where the shelf pieces come together. It is noted that central wedge shelf portion 20, having a thickness as does left and right shelf portions 14 and 18, and shaped as a trapezoidal wedge with opposite converging sides, also has the edges of the converging diagonal sides cut at an acute angle to form a beveled surface edge, rather than being a square 90-degree angle cut. The reason for the acute angle 21 on the diagonal sides of central wedge shelf portion 20 is obvious when it is seen that the same angled acute edge is also present on the diagonal sides of the left and right shelf portions 14 and 18. Thus, a fixed, frictionally held configuration results when the central wedge shelf portion 20 is fully inserted between the two shelf portions 14 and 18 permitting the acute angle cut edges 21 of central wedge 20 to co-act with the top surface of attached drawer assembly 22 to frictionally secure the acute angle cut edges of both the left and right shelf portions 14 and 18. Attached drawer assembly 22 (to wedge 20) comprises a rectangularly shaped box with contained sliding drawer 24 situated therein. Drawer 24 has attached to it a knob 26.

As is also obvious from FIG. 1, the distance from the front to the back of the shelf portions 14 and 18 shall be equal to the similar measured distance of central wedge shelf portion 20. When the subject locker shelf and drawer is assembled interiorly to a locker, central wedge shelf portion 20 will be fully engaged within the left and right shelf portions 14 and 18, wedged between such shelf portions in a snug manner, such as to assert substantial pressure against the left and right shelf portions 18, which in turn assert a lateral pressure against the inside of a locker. In this configuration, a flat level shelf made up of elements 14, 18, and 20 are presented with drawer assembly 22 immediately below the newly formed horizontal shelf. In addition, with careful measurement of the inside of the locker and with carefully cut pieces, the front edge of left and right shelf portions 14 and 18, as well as the front edge of central wedge shelf portion 20, will be in a substantially straight line when the device is in place. Of course, there may be variations in the widths of the lockers which receive the subject locker shelf and drawer assembly 10 and as those widths vary, the resulting placement of central wedge shelf portion 20 relative to the left and right shelf portions may also vary.

Importantly, it is noted that when central wedge shelf portion 20 is fully between the left and right shelf portions 14 and 18 and secure against the sides of the locker, the resultant structure is solid in construction and all parts are tightly held together. The beveled edges 15 and 19 of the acute angle of the left and right shelf portions 14 and 18 sides are frictionally held against the beveled edges 21 of the acute angle of the sides 27 and 29 of central wedge shelf portion 20 in a fixed manner. Of course, friction holds the device together and if it should be desired that the invention be disassembled for removal from the locker, all that need be done is that the drawer assembly 22 be pulled outwards, opposite to the direction of the arrow shown in FIG. 1. This will disengage central wedge shelf portion 20 from the left and right shelf portions 14 and 18 and allow the whole assembly to revert to the three basic elements originally discussed. Of course, modifications can be made to the device to ensure adequate frictional engagement between the pieces of the invention. For example, the angles of the diagonal sides may be formed such that the converging sides are close to parallel, and/or material may be added to the beveled edge to increase friction. Such material may comprise rubber or a non-setting adhesive.

Referring now to FIG. 2, a perspective view of the subject invention i a first alternate embodiment is shown where the invention has been arranged so that drawer assembly 22 now resides upon the top surface of the partial shelf formed by the alternate left shelf portion 34 and right shelf portion 38. Immediately underneath, and shown partially in dotted form, is the alternate central wedge shelf portion 40. The alternate embodiment utilizes the very same left vertical upright member 12 and right vertical upright member 16 as the embodiment of FIG. 1. It is noted that the acute angle edges 35 and 39 formed on the converging sides of left and right shelf portions 34 and 38 respectively are exactly opposite in orientation as was the case in FIG. 1. To engage the acute angle beveled edges 35 and 39 formed on the converging wedge sides of left and right shelf portions 34 and 38, the same angled acute beveled edges 41 are formed on the converging sides of central wedge shelf portion 40. Like the assembly of FIG. 1 discussed above, the subject alternate locker shelf drawer 30 is assembled similarly to the manner of assembly in FIG. 1. Now, shelf portions 34 and 38 are held between the co-acting acute angled beveled edges 41 and the bottom surface of drawer assembly 22.

Referring now to FIG. 3, a second alternate novel locker shelf and drawer assembly 50 is detailed where both the elements of the invention shown in FIGS. 1 and 2 have been combined resulting in a locker shelf and pair of drawer assemblies 22, the drawer assemblies being above and below the right and left shelf portions 14 and 18. Obviously in this embodiment, as with the embodiment of FIG. 2, the top surface of drawer assembly 22 situated on top of central wedge shelf portion 20 now becomes the book receiving means of the device when it is situated in a locker. In FIG. 3, the left vertical upright member 12 and right vertical upright member 16 are the same as utilized in the description of FIG. 1 as well as the left and right shelf portions 14 and 18 also being identical with those described in connection with FIG. 1. Lastly, the acute angled beveled edges 15 and 19 formed on the converging diagonal sides of left and right shelf portions 14 and 18 respectively are the same as detailed in FIG. 1 (although in this case, the acute angles may go either direction). The central wedge shelf portion 20 shown in FIG. 3 is identical with the same element shown in FIG. 1, here also having the acute angled beveled edges formed on the converging diagonal sides of wedge portion 20 adapted to be the same angle to the acute beveled edges 15 and 19 of left and right shelf portions 14 and 18. Attached to both the upper and the lower portion of central wedge shelf portion 20 in FIG. 3 are the pair of drawer assemblies 22 with their drawers 24 slidably contained therein with attached knobs 26. Construction, assembly, and disassembly of the second alternate novel locker shelf and drawer assembly of FIG. 3 is the same as described in connection with FIG. 1.

Also shown in FIG. 3 are strips of material 27 attached to the acute angled beveled edges 13 and 17 which provide a frictional surface to the acute angled beveled edges 21 of central wedge 20. Such material may be rubber or a non-setting adhesive.

FIG. 4 is a front view of the subject novel locker shelf and drawer assembly situated interiorly to a semi-enclosed container, such as a school locker. In more detail, locker 52, shown in a partial view, comprises two vertical sides 52*a* and 52*b*, and bottom 52*c*. The door that's usually on the locker 52 has been removed for illustration purposes. Situated interiorly to locker 52 resting upon bottom 52*c* of the locker are the two upright members, namely left and right vertical upright members 12 and 16 respectively. Attached at the top of left and right vertical upright members 12 and 16 are the left and right shelf portions 14 and 18 with centrally located central wedge shelf portion 20, central wedge shelf portion 20 urged against left and right shelf portions 14 and 18 such as to force the outside edges of shelf portions 14 and 18 against the insides of locker 52 to secure the device in place. In doing so, no space is permitted between the sides of the resultant shelf and the insides of the locker into which small items might drop. Also shown in FIG. 4 are the various acute angles on the converging diagonal side beveled edges of the left and right shelf portions 14 and 18 and central wedge shelf portion 20. More specifically, acute angled beveled edges 15 and 19 are shown on left and right shelf portions 14 and 18 respectively, and acute angled beveled edges 21 are shown on the converging sides of central wedge shelf portion 20.

Immediately below the shelf formed by shelf portions 14 and 18, and central wedge portion 20, is drawer assembly 22 with its centrally located slidable drawer 24 and pull knob 26.

It is apparent from FIG. 4 that as the central wedge shelf portion 20 engages the left and right shelf portions 14 and 18 in a forcible manner, the left and right shelf portions 14 and 18 laterally urged against the inside surfaces of locker 52 in a holding and securing manner. Further, central wedge shelf portion 20, with the attached drawer assembly 22, is itself firmly secured and the top surfaces of all these members contribute to the shelf, which may be used to receive books and papers. Of course, drawer 24, which may be pulled out to allow access to its interior, will keep smaller items, such as loose pencils and the like. Also noticed is the space between drawer assembly 22 and bottom 52c which also is adapted to receive books, and papers.

It is also obvious from FIG. 4 that a plurality of locker shelves and drawer assemblies may be stacked one upon another interiorly to the locker.

FIG. 5 is a front view of the second alternate embodiment where a second drawer assembly 22 is shown above the formed shelf. All other parts are the same as shown in FIG. 3, namely the left and right vertical upright members 12 and 16, the left and right shelf portions 14 and 18, the central wedge shelf portion 20, and drawer assembly 22.

FIG. 6 is a front view of an alternate embodiment of the left and right vertical upright members 12 and 16, and the left and right shelf portions 14 and 18 respectively, wherein, for reinforcement, a triangular shaped wedge 54 has been added in the corners of the 90-degree angle formed between the vertical upright members and the shelf portions. Obviously, in such case, the width of the drawer assembly 22 attached to the central wedge shelf portion 20 must be such as not to strike the wedges 54, but must be narrow enough to avoid the wedges.

In the embodiments shown in FIGS. 1–6, the preferred material used in the construction of the invention was wood having a thickness of ½ to 1 inch. Of course, other materials such as resilient plastic, could be utilized.

Figure 7:
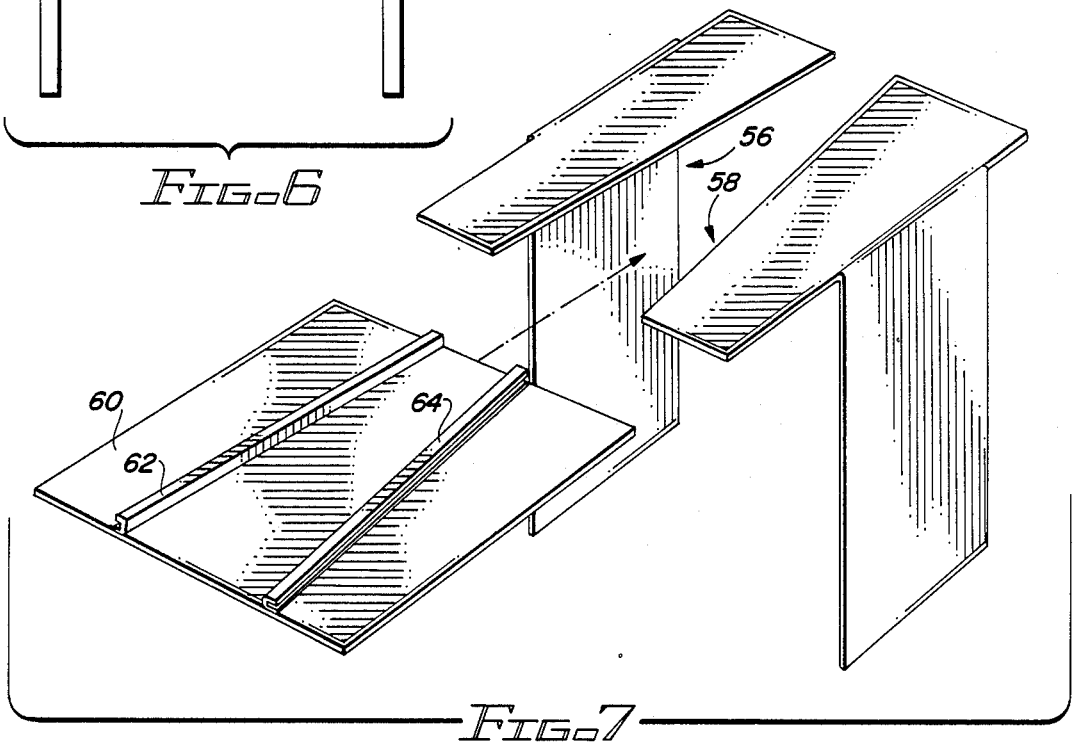
FIG. 7 is a perspective view of a third alternate embodiment of the subject invention.

FIG. 7 is a third alternate embodiment of the invention wherein construction is of sheet metal, rather than the wood construction of FIGS. 1–6. In FIG. 7, the left and right vertical upright members, and the left and right shelf portions are formed from one piece of sheet metal, the metal having a 90-degree bend at the intersection of the upright members and the shelf portions. Left upright member and shelf portion is shown as a single numeral 56, and right upright member and shelf portion is shown as a single numeral 58. The locker shelf is then completed with the element shown in the balance of FIG. 7, namely shelf 60, shelf 60 being a flat piece of sheet metal having two elongated "C" shaped troughs 62 and 64 attached to its upper surface. Like the invention shown in FIG. 1, the sides of the shelf portion of elements 56 and 58 are diagonal sides converging to the rear and the elongated troughs 62 and 64 are adapted to receive these sides respectively. Obviously in the invention of FIG. 7, the width of shelf 60 between troughs 62 and 64 and their proximate respective outside edge must be less than the corresponding width of the shelf portions of the left upright members 56 and 58. This is so because the portions of shelf 60 outside the left and right troughs 62 and 64 must reside under the shelf portions of members 56 and 58. Although a drawer assembly was not shown attached to the bottom of shelf 60, it is apparent that it may be added if desired.

A third alternate embodiment is shown in FIG. 7 assembled similarly as the embodiments shown in FIGS. 1–5 wherein the placement of the left and right upright members and shelf portions 56 and 58 in a locker is accomplished by forcibly urging these members against the inside portion of the locker by the sliding in of the shelf 60 where the converging sides of members 56 and 58 slide interiorly to "C" troughs 62 and 64. Thus the operation of the third alternate embodiment shown in FIG. 7 is identical to that in principle of the subject invention.

Figure 8:
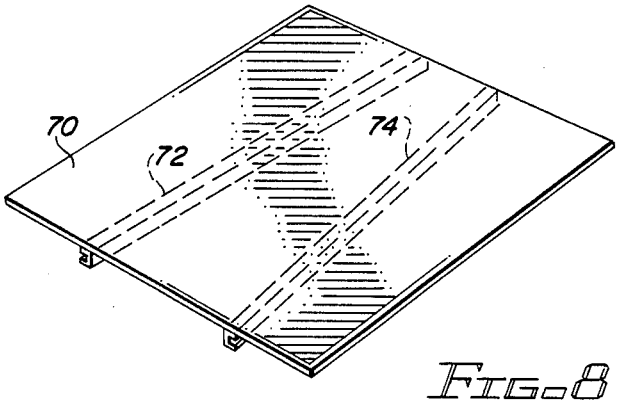
FIG. 8 is an alternate embodiment of a portion of the subject invention illustrated in FIG. 7.

FIG. 8 shown an alternate embodiment of shelf 60, namely shelf 70, wherein the two troughs 72 and 74 are located on the underside of shelf 70 so that, in utilizing shelf 70 with the left and right upright members and shelf portions 56 and 58, the top smooth surface of shelf 70 becomes the usable shelf of the device and the left and right upright members and shelf portions 56 and 58 are totally covered so that a smooth continuous shelf is presented. It is noted that the shelf shown in FIG. 8 is identical to the shelf of FIG. 7, the shelf only having been rotated by 180-degrees.

While a preferred embodiment and alternate embodiments of the apparatus have been shown and described, it will be understood that there is no intent to limit the invention by such disclosure, but rather it is intended to cover all modifications of the apparatus and alternate constructions falling with the spirit and the scope of the invention as defined in the appended claims.

I claim:

1. A locker shelf and drawer assembly removably secured interiorly of a semi-enclosed locker container having a floor, two opposite sides, and a front and a rear, the locker shelf and drawer assembly comprising:

a composite shelf spatially suspended above the floor of the container, said composite shelf defining:

(a) a left shelf portion having opposite first and second sides;

(b) a right shelf portion having opposite first and second sides; and (c) a center shelf portion having opposite sides, each said first sides of said left and right shelf portions frictionally engaging an opposite side of said center shelf portion, and each said second sides of said left and right shelf portions forcibly engaging an opposite side of the semi-enclosed container;

a slidable drawer assembly operably attached to said composite shelf; and a pair of side pieces attached to said composite shelf, both said side pieces engaging the floor of the locker to suspend said shelf spatially above the floor.

2. The locker shelf and drawer assembly as defined in claim 1 wherein said left shelf portion first and second sides are at a diagonal angle to each other and said right shelf portion first and second sides are at a diagonal angle to each other.

3. The locker shelf and drawer assembly as defined in claim 2 wherein said first side of each said left shelf portion and said right shelf portion are proximate each other and converge from the front of the locker toward the rear of the locker at a fixed angle.

4. The locker shelf and drawer assembly as defined in claim 3 wherein said center shelf portion defines a member having a top flat surface with said opposite sides at an angle to each other converging from the front of the locker toward the rear of the locker, said center shelf portion defining a trapezoid.

5. The locker shelf and drawer assembly as defined in claim 4 wherein said angle of said pair of converging opposite sides of said center shelf portion is the same fixed angle as both said left and right shelf portions converging first sides.

6. The locker shelf and drawer assembly as defined in claim 5 wherein said slidable drawer assembly operably attached to said composite shelf defines said slidable drawer assembly attached to said center shelf portion.

7. The locker shelf and drawer assembly as defined in claim 6 wherein each said first side of both said left and right shelf portions define an acute angle beveled edge.

8. The locker shelf and drawer assembly as defined in claim 7 wherein each converging opposite sides of said center shelf portion define an acute angle beveled edge.

9. The locker shelf and drawer assembly as defined in claim 8 wherein said acute angle beveled edge of each said first side of said left and right shelf portion is at a complimentary angle to the acute angle beveled edges of said opposite sides of said center shelf portion.

10. The locker shelf and drawer assembly as defined in claim 9 wherein said slidable drawer assembly attached to said center shelf portion defines a box having a slidable drawer therein, said box having a flat surface attached to said center shelf portion, said drawer box flat surface co-acting with said center shelf portion acute angle beveled edges of said opposite sides to frictionally secure said acute angle beveled edges of said left and right shelf portions first sides whereby when said center shelf portion is frictionally secured between said left and right shelf portions, said left and right shelf portions are urged laterally to forcibly engage the semi-enclosed container opposite sides.

11. The locker shelf and drawer assembly as defined in claim 10 wherein said pair of side pieces attached to said composite shelf defines a left side piece attached to said left shelf portion proximate said second side, and a right side piece attached to said right shelf portion proximate said second side.

12. A locker shelf assembly removably secured interiorly of a semi-enclosed locker container having a floor, two opposite sides, and a front and a rear, the locker shelf assembly comprising:

a composite shelf spatially suspended above the floor of the container, said composite shelf defining:

(a) a left shelf portion having opposite first and second sides;

(b) a right shelf portion having opposite first and second sides; and (c) a center shelf portion having opposite sides, each said left and right shelf portions first sides frictionally engaging said center shelf portion, and each said second sides of said left and right shelf portions forcibly engaging an opposite side of the semi-enclosed container; and a pair of side pieces attached to said composite shelf, both said side pieces engaging the floor of the locker to suspend said shelf spatially above the floor.

13. The locker shelf assembly as defined in claim 12 wherein said left shelf portion first and second sides are at a diagonal angle to each other, and said right shelf portion first and second sides are at a diagonal angle to each other.

14. The locker shelf assembly as defined in claim 13 wherein said first side of each said left shelf portion and said right shelf portion are proximate each other and converge from the front of the locker toward the rear of the locker at a fixed angle.

15. The locker shelf assembly as defined in claim 14 wherein said center shelf portion includes a flat surface member having a pair of elongated troughs attached to said flat surface, said troughs so arranged as to be at an angle to each other and to converge from the front of the locker toward the rear of the locker.

16. The locker shelf assembly as defined in claim 15 wherein said angle of said troughs attached to said center shelf portion flat surface is the same fixed angle as both said left and right shelf portions converging first sides, said troughs adapted to frictionally engage said first sides of said left shelf portion and right shelf portion whereby when said center shelf portion is frictionally secured between said left and right shelf portion, said left and right shelf portion are urged laterally to forcibly engage said semi-enclosed container opposite sides.

17. The locker shelf assembly as defined in claim 16 wherein said pair of side pieces attached to said composite shelf defines a left side piece attached to said left shelf portion proximate said second side, and a right side piece attached to said right shelf portion proximate said second side.

* * * * *